US006709125B2

(12) United States Patent
Jarvis

(10) Patent No.: US 6,709,125 B2
(45) Date of Patent: Mar. 23, 2004

(54) EASY OPEN DEVICE FOR BEVERAGE CANS

(76) Inventor: Harold Jarvis, 1411 N. Kenmore Rd., Indianapolis, IN (US) 46219

( * ) Notice: Subject to any disclaimer, the term of this patent is extended or adjusted under 35 U.S.C. 154(b) by 24 days.

(21) Appl. No.: 10/202,508

(22) Filed: Jul. 25, 2002

(65) Prior Publication Data

US 2004/0017676 A1 Jan. 29, 2004

(51) Int. Cl.[7] ..... F21V 33/00

(52) U.S. Cl. ..... 362/84; 81/3.55; 362/253; 362/119

(58) Field of Search ..... 362/253, 84, 119, 362/109, 120; 81/3.55, 462, 177.1, 489

(56) References Cited

U.S. PATENT DOCUMENTS 4,373,246 A * 2/1983 VanHoutte et al. ..... 29/426.4
4,466,313 A * 8/1984 Gardner ..... 81/3.46 R
5,277,083 A * 1/1994 Madonia ..... 81/3.09
5,359,911 A * 11/1994 Karvesi ..... 81/436
RE37,190 E * 5/2001 Stowell et al. ..... 16/422

* cited by examiner

*Primary Examiner*—Laura K. Tso
(74) *Attorney, Agent, or Firm*—Daniel O'Connor

(57) ABSTRACT

A handle device to provide easy opening of pull tab beverage cans. The handle includes a copper tubing element with a lower flattened end to be placed over a pull tab. Strengthening means and a lighting element are located on a lower end of the easy opening device. A support stand is included in the design to provide easy access and convenient storage. The design is highly useful for arthritis sufferers and avoids broken finger nails.

1 Claim, 2 Drawing Sheets

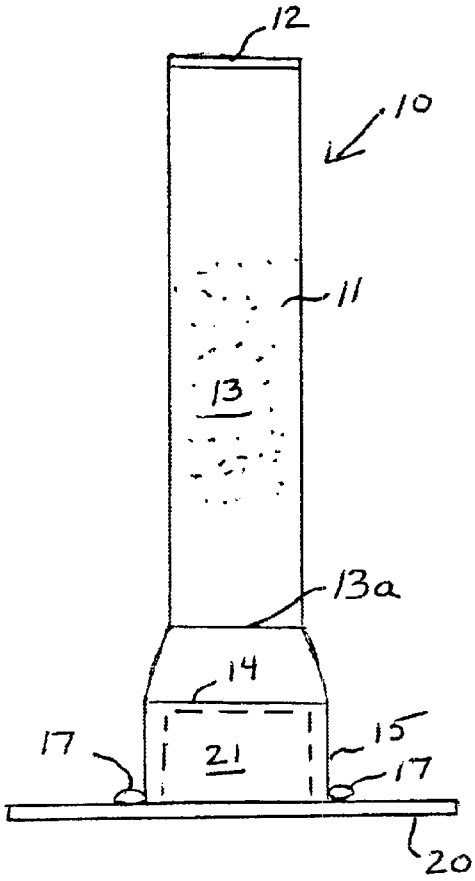
FIG. 2.
FIG. 4.
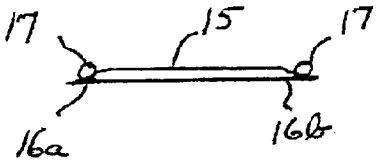
FIG. 3.
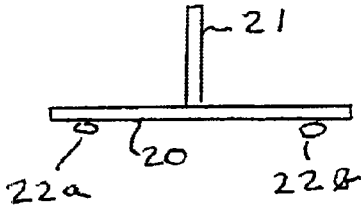

EASY OPEN DEVICE FOR BEVERAGE CANS

BACKGROUND AND OBJECTS OF THE INVENTION

The present invention is generally related to the dispenser opening arts and, in particular, to a novel handle design for opening most beverage cans and other containers.

Devices to assist with the opening of pull tab cans have been shown in the art.

It is an object of the present invention to improve upon such devices by utilizing features which enhance safety and ease of use.

It is a further object of the invention to set forth a support element so the opener can be more easily accessed and stored.

It is also an object of the invention to demonstrate an opening device with improved non-slip grip handle means.

The device further includes formed strengthening means located at an end portion thereof.

The design further includes a rounded and coated end cap for more comfort for the user.

The device reduces broken finger nails and other injuries and is of great assistance for arthritis sufferers.

A lighted glow strip or equivalent lighting means may be included in the device for use in low-lighting environments.

These and other objects and advantages of the invention will be appreciated by those of skill in the art from the description which follows.

PRIOR ART PATENTS AND DESIGNS

U.S. Pat. Nos. 5,277,083 and 6,311,580 show can opening designs which are related to the present invention.

The invention disclosed herein includes added safety and storage features which are not shown in the prior art.

The invention further includes formed strengthening means and lighting elements for ease of use in darkened locations.

SUMMARY OF THE INVENTION

The pull tab opening handle is formed of copper tubing approximately four inches in length.

A plug is inserted into the upper end of the opener and the upper end is coated with a non-slip grip solution comprising, for example, a rubber type coating.

The lower end of the opener is crimped into a flat and open shape to fit over a standard-sized pull tab of a beverage container.

Strengthening ridges are formed at the sides of the end of the opener.

Lighting materials may be included at the lower end of the opener.

A lower stand is included with the invention and is fabricated of plastic or equivalent materials. The stand provides for easy storage of and easy access to the handle.

BRIEF DESCRIPTION OF THE DRAWING FIGURES

FIG. 2 is a side view of the opening handle 10 in a position mounted on top of a lower plastic support base.

FIG. 3 is a side view of the lower support base having an upwardly extending element for receipt of the opening handle.

FIG. 4 is an end view of the opening handle and indicates the strengthening ridges and lighting elements which are a part thereof.

FULL DESCRIPTION OF A PREFERRED EMBODIMENT

Figure 1:
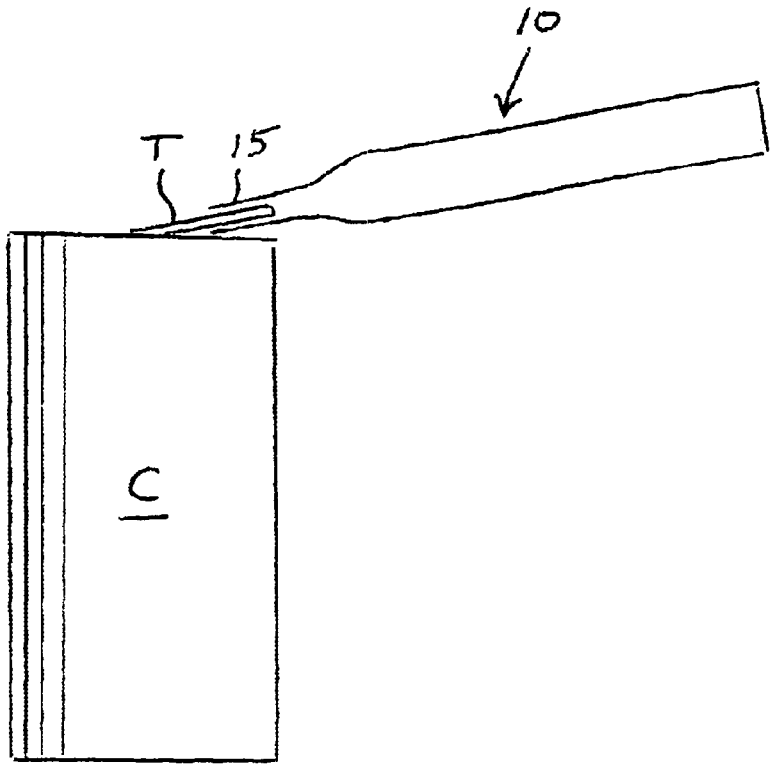
FIG. 1 shows the opening handle 10 as applied to a beverage container C having a pull tab T on top thereof.

Referring to the drawing figures, FIG. 1 shows the easy opening handle 10 as used in combination with a typical beverage can C having a pull tab type opener T.

In the side view of FIG. 2, the handle 10 has an upper body portion 11 and an end cap or plug 12.

The upper body portion 11 is coated with a non-slip grip coating 13 which comprises a rubber compound. The non-slip coating 13 extends to a line 13*a* of the upper body portion 11.

A crimp is formed at line 14 on a lower portion of the handle 10 such that a flattened area 15 is provided at a lower end of the opener in order to grasp a tab T.

A lighting element 17 may be included on the lowest point of the opener 10. The lighting element may comprise glow-type lighting or other equivalent means.

As further shown in FIG. 2, the lower portion of opening handle 10, i.e. at flattened area 15, is placed onto a stand 20 having a vertically extending element 21.

The stand 20 and attached vertical element 21 are comprised of plastic or other durable materials.

The stand 20 is a significant aspect of the over-all invention since it provides for convenient storage and easy access to the opening handle 10.

A side view of the support stand 20 is shown in FIG. 3. Vertical element 21 is again shown.

The support stand 20 may include at least two anti-skid attachments 22*a* and 22*b* affixed to the bottom of stand 20.

FIG. 4 shows an end view of the lower portion of handle 10. As previously described, the lower end 15 is flattened and sized so as to fit over a standard pull tab element.

As further shown in FIG. 4, the side portions of opening 15 are completely flattened together as indicated at numerals 16*a* and 16*b*. Such edge strengthening at 16*a* and 16*b* provides for enhanced strength and long life for the overall unit in its usage to open pull tab elements.

The end view of FIG. 4 also shows the lighting means 17 which are useful for display purposes and also for usage in darkened environments.

The method steps used in making the device include:

a) cutting a copper tube to a four inch length,
b) flattening an end section 15 of said tubing such that strengthening edges 16*a* and 16*b* are formed thereon,
c) adding a plug 12 to an upper end of the unit.
d) dipping the upper end of the unit into a rubber compound solution to provide a gripping area 13,
e) adding lighting elements to a lower end of the unit,
f) placing the opener 10 on a stand 20 having a piece 21 for receiving the lower end 15.

From the previous description, it will be appreciated that a high quality and long-life pull tab opener has been demonstrated.

The utility and safety features include:

a) the non-slip grip handle for safer use,
b) strengthening means 16*a,* 16*b* at the end of the opener,
c) lighting means for darker environments,
d) a storage base 20 for ease of access to the opener when needed.

The invention is further defined by the claims appended hereto.

While particular materials and product dimensions have been shown and described, it is intended in this specification to broadly cover all equivalent structures and methods which would reasonably occur to those of skill in the art.

I claim:

1. An opener used in combination with a beverage can(C) having a pull tab element(T) thereon, said opener (10) comprising a length of copper tube having a handle end (11) formed thereon, said opener having a plug (12) placed in an upper end thereof, said opener having a lower end (14) which has a flattened area (15) sized to be placed over the pull tab(T) of a beverage can, strengthening means (16*a,* 16*b*) being formed at a lower end of said opener, wherein the upper end of said handle (11) and said plug element (12) are coated with a non-slip grip rubber coating, the opener further including lighting means (17) at a lower end thereof for use in low-light areas, the opener further including a base (20) for storage of the device, said base having a vertical means (21) attached thereto.

* * * * *